United States Patent [19]

Galarneau

[11] Patent Number: 4,735,516

[45] Date of Patent: Apr. 5, 1988

[54] PRINTER HEAD FOR BRAILLE PRINTER

[75] Inventor: Roland Galarneau, Quebec, Canada

[73] Assignee: Brail-Tech Inc., Quebec, Canada

[21] Appl. No.: 17,274

[22] Filed: Feb. 20, 1987

Related U.S. Application Data

[63] Continuation-in-part of Ser. No. 828,604, Feb. 11, 1986, abandoned, which is a continuation of Ser. No. 662,018, Oct. 18, 1984, abandoned.

[30] Foreign Application Priority Data

May 17, 1984 [CA] Canada ..... 454619

[51] Int. Cl.[4] ..... B41J 3/12; B41J 3/32

[52] U.S. Cl. ..... 400/122; 101/18

[58] Field of Search ..... 400/122; 101/93.04, 101/18

[56] References Cited

U.S. PATENT DOCUMENTS

| | | | |
|---|---|---|---|
| 3,132,962 | 5/1964 | Seymour | 434/113 X |
| 3,880,269 | 4/1975 | Carbonneau | 101/18 X |
| 3,941,051 | 3/1976 | Barrus | 101/93.04 |
| 4,183,683 | 1/1980 | Hiratsuka | 400/122 |
| 4,488,828 | 12/1984 | Ohtsuki | 400/122 X |

FOREIGN PATENT DOCUMENTS

| | | | |
|---|---|---|---|
| 2700536 | 7/1978 | Fed. Rep. of Germany | 400/122 |
| 131578 | 8/1982 | Japan | 400/122 |
| 102772 | 6/1983 | Japan | 400/122 |
| 177292 | 3/1922 | United Kingdom | 400/122 |

OTHER PUBLICATIONS

*IBM Tech. Disc. Bulletin*, Jacobs, vol. 8, No. 10, Mar. 1966, p. 1424, "Embossing Braille Characters".

*IBM Tech. Disc. Bulletin*, Loeber, vol. 11, No. 12, May 1969, p. 1649, "Random Braille Printer".

*Primary Examiner*—Paul T. Sewell

*Attorney, Agent, or Firm*—Michael N. Meller

[57] ABSTRACT

A device for embossing braille characters on an embossable substrate includes the combination of a feed device advancing the substrate and embossing head for embossing dots on the substrate. The embossing head is movable relative to the feed device to emboss horizontal lines of dots on the substrate in predetermined patterns. One horizontal line of Braille characters can be printed on a substrate by the embossing of three horizontal lines of dots on the substrate, the substrate being advanced between the horizontal lines of dots by the feed device.

3 Claims, 2 Drawing Sheets

PRINTER HEAD FOR BRAILLE PRINTER

This application is a continuation-in-part of application Ser. No. 828,604, filed 2-11-86 a continuation of application Ser. No. 662,018, filed Oct. 18, 1984, both abandoned.

The invention relates to a printer head for a braille printing machine. More particularly, the printer head of the present invention is especially useful in a printing machine interfaced with a computer which is provided with the appropriate software for formulating pages of braille text from an input of sight readable alphanumeric data.

It is known, in general, to provide a computer driven braille printing machine. There are, in fact, several such machines known to the applicant. For instance, in U.S. Pat. No. 3,380,269 issued Apr. 29, 1975 to Carboneau, a braille printer is disclosed in which, lines of braille dots are printed (i.e. embossed for touch reading) simultaneously (three consecutive such lines of dots comprising a line of braille characters) as paper is drawn lengthwise through a printer (usual typewriter fashion). The dots are printed by a line of braille printing pins, one for each potential dot in a line, set normal to a braille printable paper underneath the path of travel of same. Each pin travels in a guide path bored in a frame and is actuated by a lever which is powered by a solenoid. Actuation of the solenoid pulls its associated lever downwardly, causing the opposite end of the lever to power the pin upwardly into the substrate paper. This is certainly a functional arrangement for a printer, but it requires a solenoid-lever-pin combination for each dot in a line of braille dots. Moreover, this device requires a large rigid frame on which the many solenoid-lever-pin combinations can be mounted.

Other, more conventional, but nonetheless electronic braille printers are also known. For instance, in U.S. Pat. No. 4,488,828, Ohtsuki utilizes solenoids to print braille characters one at a time, typewriter-style.

The principal drawback with machines that print one character at a time is that the solenoids which power the print pins must be capable of powering six pins at once, like a stamping machine, and the blow which they deliver to the substrate is, therefore, quite strong and loud.

Also, it is known, as taught by Loeber in IBM Technical Disclosure Bulletin, Volume II, No. 12 in May, 1969, to print braille dots one at a time with a braille printing pin mounted at the end of, and co-axial with, the plunger of a solenoid. While embodying (as explained below) one feature of the present invention, this device is not an automated printer. Rather, it is a device for printing single braille dots at any desired location on a page.

In view of the foregoing, it will be appreciated that it is known to provide a braille printing machine controlled by a computer. It is also known that a braille printing machine will include means for advancing a printable substrate paper therethrough, as taught by Carboneau. Moreover, it is shown in, for instance, German Offenlugungsschrift No. 2700536 dated 13/7/78 (Brill) that a print head or "stamp" may be mounted on a rail for lateral motion, in increments, across the paper to be embossed.

However, in known braille printing machines, such as those described in general terms in the preamble of the broad claim appended hereto, the printing of braille has been in a character-by-character fashion, one character, or even only one dot, at a time.

The trend in high-speed printing has been, as noted above in relation to Carboneau, to abandon the concept of a moving head, in favour of a system providing a single braille printing pin for each vertical row of braille dots on a page.

Accordingly, it will be seen that it has not heretofore been apparent to give the job of printing some, but not all braille dots in a line of braille dots to one electrically actuatable printing pin. Put in other terms, it has not heretofore been apparent to divide a page conceptually into vertical columns of characters, and provide a printing head with numerous printing pins on it, each capable of printing the dots in one such conceptual column. By providing such a printing head, in a practical embodiment, the present invention essentially divides up a page into as many vertical columns as it has printing pins, and prints a page in a corresponding fraction of the time it would take a machine with a printing head having only one pin.

It is an object of the present invention to provide for a novel printer head for use on a printer which will print one line of braille characters simultaneously. The printer head contains a plurality of solenoids, each of which can be independently actuated. Each solenoid controls the forward movement of a pin co-axial therewith, which can cause an embossed dot to be created on a sheet of paper at a predetermined location. The forward movement of the pin is limited by a small depression located on the other side of an inserted sheet of paper on which the braille impressions are to be embossed. The printer head of the present invention can be moved across the paper.

In a broad aspect, the present invention relates to an improvement for a braille printing machine which is provided with: (a) a main body with a rigid framework; (b) means for incrementally advancing braille-embossable paper through said main body; (c) a rail mounted on said main body transverse to the direction of incremental advancement of said braille embossable paper; (d) a printing head mounted on said rail for reciprocal movement thereon across said braille-embossable paper to emboss braille-readable characters on said paper; (e) motor means for moving said printing head in incremental reciprocating fashion on said rail, across said paper, to emboss said braille characters; (f) an imput port for receiving a computer generated signal capable of addressing said means (b) for incrementally advancing said paper, said motor means (e) and said printing head (d), to emboss braille characters at predetermined locations on said paper to print braille-readable script; comprising a printing head having a rigid frame mounted on said rails (c) for reciprocal movement thereacross, said frame having a long plate portion below said paper, a portion above said paper, with a narrow slot therebetween for the passage of said paper, and mounted on the portion above said paper a plurality of solenoids spaced apart by the distance between a desired motor of braille characters, each solenoid being mounted normal to the direction of advancement of paper through said slot, and each having a braille printing pin co-axial to the shaft thereof for advancement through a bore in the base of its associated solenoid upon electrical actuation thereof, there being a rounded indentation in the said plate opposite the printing pin of each solenoid, whereby actuation of a said solenoid will form a braille readable dot in said paper; there being a space at each end of said frame of said printing head without solenoids mounted thereon to permit reciprocation of said frame on said rail while said paper passes through said slot; operation of said printing head first from left to right and then, following an incremental advance of said paper within said slot, from right to left, causing lines of braille dots to be embossed on said paper, three said left to right or right to left operations embossing a line of braille characters, after which said paper advances a greater incremental distance corresponding to the spacing of braille characters on a page script.

Specific reference will be made to the accompanying drawings.

Figure 1:
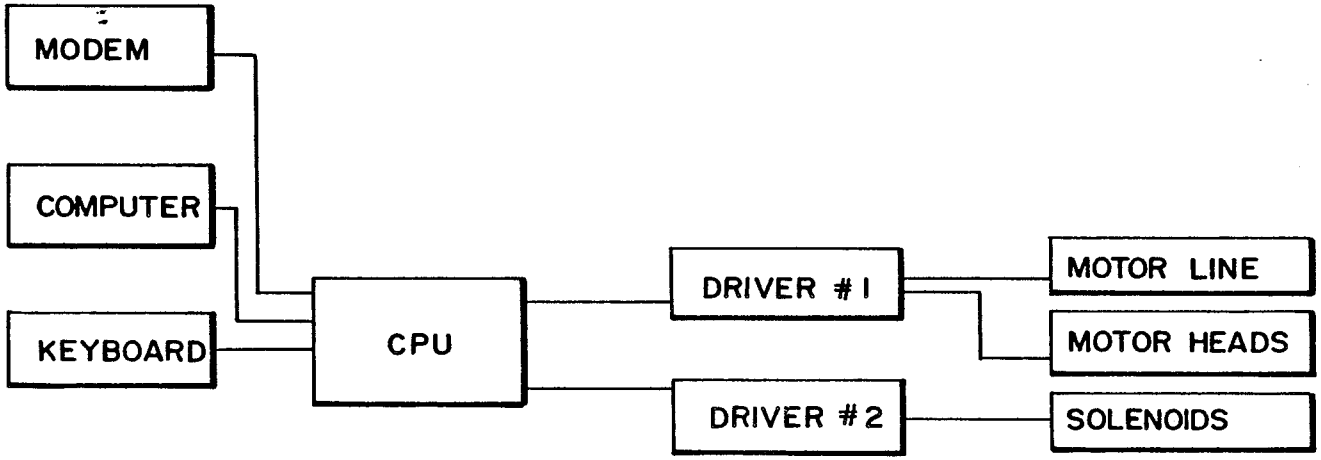
FIG. 1 is a block diagram of a computer system employing the present invention as a printer terminal.

Referring to FIG. 1, a CPU is accessed either through a keyboard, a modum, or a computer. The CPU contains appropriate hardware and software to translate the input signals into specific output signals and thereby translate alphanumeric characters which are input into braille characters. One output from the CPU goes to the motor of the print head to move it across the rails of a printer, said rails being disposed above the path of travel of an embossable paper substrate. Other outputs address a plurality, preferably ten or eleven solenoid switches, which switches can be actuated in a manner outlined below to create braille script on an embossable sheet.

Figure 2:
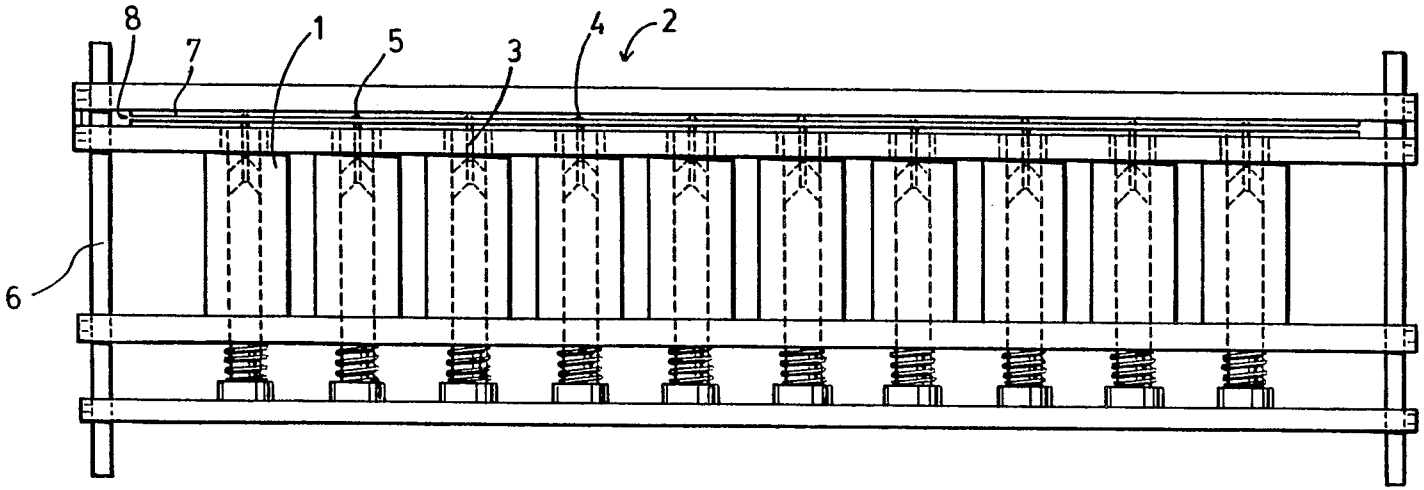
FIG. 2 is a diagram showing the braille printer head of the present invention.

FIG. 2 shows a printing head 2 according to the present invention having ten fixed solenoids 1 mounted on a rigid frame 6 which is movable in reciprocal fashion on the rails of a printing machine. Motor means (not illustrated but know in the printing art) are provided in the machine for moving the head in a lateral fashion across the path of travel of the embossable substrate, such as embossable paper.

Each of the solenoids 1 shown in FIG. 2 contains a small pin 3 or rod-shaped body which will form a braille dot on an embossable sheet of paper when the solenoid 1 is energized. When a solenoid 1 is energized, the rounded end 4 of the pin is propelled upwardly toward the paper which will be in the area of slot 8 until it comes into contact with the paper. Directly opposite each pin 3, in a limiting plate 7, mounted on frame 6, on the other side of the paper slit 8, is a small, round depression 5 which limits the forward movement of the pin opposite it. This enables a precise braille impression to be formed on the embossable sheet at a predetermined location.

Moreover, as can be seen in FIG. 2, a space or margin is provided at each end of the printing head of the present invention. The function of this space is to permit the paper to pass through slit 8, while at the same time having the limiting plate 7 and all of the solenoids 1 rigidly mounted on frame 6. It will be appreciated that the space or margin at each end is about the same length as the spacing between two of the solenoids (which are equally spaced apart the distance between four braille characters in a preferred embodiment). By providing this space, the print head may initially be aligned so as to begin printing dots on the left side of a page. In this case, the paper in slot 8 will extend into the right margin of the print head. As the print head progresses laterally across the page until it finishes embossing a line of dots, the direction of travel of the head will be from left to right. It will be understood then, that during such lateral motion, the paper will eventually leave the right margin of the print head, and enter the left margin.

The braille printer head of the present invention is programable to print the first, or top one-third of a full line in a full horizontal sweep of the head. As the head returns to its initial position, it prints the second or middle third of the full line, and then does the last, or bottom third of the full line, which is the third part of each braille cell.

In a preferred embodiment, the head of the printer comprises ten solenoids, and a full horizontal sweep of the head is done in eight steps, to print two horizontal dots for each of forty characters, which comprise a full line of printing. The space between two adjacent dots in a cell is 3/32" and the space between two cells in a word is 5/32". The space between two lines of characters is preferably 7/32". Take note that it prints both directions as described below:

| | |
|---|---|
| (a) 1st line of braille characters (top third of forty characters) | |
| * first full horizontal sweep (to the right): | |
| Dots 1 and 4 of forty characters | Paper advance (3/32") |
| * second full horizontal sweep (to the left): | |
| Dots 5 and 2 of forty characters | Paper advance (3/32") |
| * third full horizontal sweep (to the right): | |
| Dots 3 and 6 of forty characters | Line advance (7/32") |
| (b) 2nd line of braille characters | |
| * first full horizontal sweep (to the left): | |
| Dots 4 and 1 of forty characters | Paper advance (3/32") |
| * second full horizontal sweep (to the right): | |
| Dots 2 and 5 of forty characters | Paper advance (3/32") |
| * third full horizontal sweep (to the left): | |
| Dots 6 and 3 of forty characters | Line advance (7/32") |
| (c) 3rd line of braille characters | |
| * first full horizontal sweep (to the right): | |
| Dots 1 and 4 of forty character | Paper advance (3/32") |
| * second full horizontal sweep (to the left): | |
| Dots 5 and 2 of forty characters | Paper advance (3/32") |
| * third full horizontal sweep (to the right): | |
| Dots 3 and 6 of forty characters | Line advance (7/32") |

Figure 3:
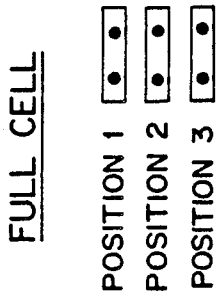
FIG. 3 shows a typical braille cell broken down into a matrix of two horizontal dots by three vertical dots.

The first command from the CPU causes the printer head to move as a unit to the right to emboss the top third of a line (Dots 1 and 4, Position 1 in FIG. 3); the second command from the CPU causes a paper advance of 3/32" to align the head to emboss those impressions located in Position 2 of FIG. 3.

The next command causes printer head to move as a unit to the left and emboss those impressions located in Position 2 of FIG. 3. The next command causes a paper advance of 3/32".

The next command causes the printer head to move as a unit to the right and emboss those impressions located in Position number 3.

The last command from the CPU causes a line advance of 7/32".

At this point, after these three (3) full movements of the printer head, an entire line of forty (40) braille characters has been embossed and the paper will have advanced so that embossing of the next line of braille characters as described above can commence.

Using suitable software, the printer can emboss braille characters up and down the page rather than across the page as previously described. In doing so, it would emboss a matrix of twenty four lines by eighty characters or more. After this matrix is completely printed, the paper can be advanced to a position to add subsequent twenty four lines by eighty characters or more so that the length of a line would be limited only to the length of the paper on which it is printed.

Using more sophisticated software, the printer can also emboss graphic display. The mechanical and hardware designs are done so it is possible to emboss dots 1/32" apart in every direction.

I claim:

1. In a Braille printing machine which is provided with:

(a) a main body with a rigid framework;

(b) means for incrementally advancing braille-embossable paper through said main body;

(c) a rail mounted on said main body transverse to the direction of incremental advancement of said braille-embossable paper;

(d) a printing head mounted on said rail for reciprocal movement thereon across said braille-embossable paper to emboss braille-readable characters on said paper;

(e) motor means for moving said printing head in incremental reciprocating fashion on said rail, across said paper, to emboss said braille characters; and (f) an imput port for receiving a computer generated signal capable of addressing said means (b) for incrementally advancing said paper, said meter means (e) and said printing head (d), to emboss braille characters at predetermined locations on said paper to print braille-readable script;

the improvement comprising a printing head comprising a rigid frame mounted on said rails (c) for reciprocal movement thereacross, said frame having a long plate portion below said paper, a portion above said paper, with a narrow slot therebetween for the passage of said paper, and mounted on the portion above said paper a plurality of solenoids spaced apart by the distance between a desired number of Braille characters, each solenoid being mounted normal to the direction of advancement of paper through said slot, and each having a Braille printing pin co-axial to the shaft thereof for advancement through a bore in the base of its associated solenoid upon electrical actuation thereof, there being a rounded indentation in the said plate opposite the printing pin of each solenoid, whereby actuation of a said solenoid will form a braille readable dot in said paper; there being a space at each end of said frame of said printing head without solenoids mounted thereon to permit reciprocation of said frame on said rail while said paper passes through said slot; operation of said printing head first from left to right and then, following an incremental advance of said paper within said slot, from right to left, causing lines of braille dots to be embossed on said paper, three said left to right or right to left operations embossing a line of braille characters, after which said power advances a greater incremental distance corresponding to the spacing of braille characters on a page script.

2. The improvement of claim 1, wherein ten said solenoids are provided, spaced apart the distance between the first dots in braille characters four characters apart.

3. The improvement of claim 1, wherein eleven said solenoids are provided, spaced apart the distance between the first dots in braille characters four characters apart.

* * * * *